US005713309A

United States Patent [19]

Higashi

[11] Patent Number: 5,713,309

[45] Date of Patent: Feb. 3, 1998

[54] STEAM GENERATOR

[76] Inventor: Kenji Higashi, 6-6-26 Chiyoda, Takaishi-shi Osaka 592, Japan

[21] Appl. No.: 621,647

[22] Filed: Mar. 26, 1996

[30] Foreign Application Priority Data

Aug. 9, 1994 [JP] Japan ..... 209203

[51] Int. Cl.[6] ..... F22B 27/00

[52] U.S. Cl. ..... 122/40; 122/31.1

[58] Field of Search ..... 122/31.1, 39, 40; 261/108, 112.1; 454/274

[56] References Cited

U.S. PATENT DOCUMENTS

| | | | |
|---|---|---|---|
| 3,110,797 | 11/1963 | Vanne et al. | 122/40 |
| 3,623,457 | 11/1971 | Dillstrom | 122/31 |
| 3,974,840 | 8/1976 | Doyle et al. | 34/99 |
| 5,279,262 | 1/1994 | Muehleck | 122/26 |
| 5,392,738 | 2/1995 | Tsutsumi | 122/31.1 |

FOREIGN PATENT DOCUMENTS

| | | | |
|---|---|---|---|
| 0 233 535 A2 | 8/1987 | European Pat. Off. . | |
| 3-30001 | 3/1991 | Japan . | |
| 6-63103 | 3/1994 | Japan . | |
| 6-78965 | 3/1994 | Japan . | |
| 06277261 | 10/1994 | Japan | 33/10 |
| 6-277261 | 10/1994 | Japan . | |

*Primary Examiner*—Henry A. Bennett
*Assistant Examiner*—Gregory Wilson
*Attorney, Agent, or Firm*—Armstrong, Westerman, Hattori, Mcleland & Naughton

[57] ABSTRACT

There is provided a compact and lightweight steam generator capable of efficiently and economically generating steam. An impeller is disposed in a housing. While the impeller is rotated by hot water poured inside the housing through a hot water inlet, the hot water is spread to generate steam inside the housing. By a ventilation fan to be operated in association with the impeller, the steam generated inside the housing is blown off into a shower room. The hot water poured inside the housing is discharged to the inside of a hot water reservoir through a discharge port. Steam generated inside the hot water reservoir, is drawn into the inside of the housing and then blown off into the shower room.

5 Claims, 6 Drawing Sheets

STEAM GENERATOR

This application is a continuation of International Application No. PCT/JP95/01571, filed Aug. 7, 1995, and claiming priority based on Japanese Patent Application No. 209203 filed Aug. 9, 1994.

BACKGROUND OF THE INVENTION

The present invention relates to a steam generator for generating steam in a bath or shower room with the use of hot water.

To heat a domestic bath or shower room or to utilize a domestic bath or shower room as a simple steam bath, a variety of steam generators are conventionally proposed.

Each of such steam generators generally needs a dedicated heat source such as an electric heater or the like. This disadvantageously increases the cost. Further, to install a steam generator in a bath or shower room, pipings, wirings and the like are required. This makes it difficult to install a steam generator in an existing house.

In view of the foregoing, there is proposed a steam generator in which hot water supplied from an existing hot water supply unit, flows down along an inclined plate to generate steam (See Japanese Utility Model Laid-Open Publication No. 3-30001 for example). To generate steam in a desired amount by this steam generator, it is required to broaden the area of the inclined plate along which hot water is to flow. This disadvantageously increases the steam generator in size and weight. Further, this steam generator is arranged such that the hot water having flowed on the inclined plate, is let to fall down as it is. This is wasteful.

OBJECT AND SUMMARY OF THE INVENTION

In view of the foregoing, the present invention is proposed with the object of providing a compact and lightweight steam generator capable of efficiently generating steam.

It is another object of the present invention to provide a steam generator capable of economically generating steam.

To achieve the objects above-mentioned, the present invention provides a steam generator comprising: a hollow container-like housing having a hot water inlet through which hot water is to be poured, a discharge port through which the hot water thus poured is discharged into a hot water reservoir, air intake ports for drawing steam in the hot water reservoir, and a steam supply port for supplying the steam into a room; an impeller disposed inside the housing and arranged to receive and spread hot water poured into the inside of the housing through the hot water inlet; and a ventilation fan for blowing off steam generated inside the housing, into the room through the steam supply port.

According to the steam generator having the arrangement above-mentioned, hot water is poured inside the housing through the hot water inlet from a hot-water supply cock or the like, and the hot water thus poured is received and spread by the impeller to generate steam inside the housing. The steam thus generated can be blown off into the room such as a bath room, a shower room or the like through the steam supply port by the ventilation fan. Further, the hot water poured inside the housing can be stored in the hot water reservoir through the discharge port, and steam generated in the hot water reservoir can be drawn inside the housing through the air intake ports by a sucking operation of the ventilation fan. Together with the steam generated by the impeller, the steam thus drawn can be blown off into a bath room through the steam supply port.

As discussed in the foregoing, since the steam generator having the arrangement above-mentioned generates steam by spreading hot water by the impeller disposed inside the housing, the steam can efficiently be generated. Further, together with the steam generated by the impeller, the steam generated by the hot water stored in the hot water reservoir is blown off to the room. Thus, steam can more efficiently be supplied into the room. Further, the hot water poured inside the housing can be stored in the hot water reservoir through the discharge port and reused for bath or the like.

According to a preferred embodiment, the steam generator of the present invention is arranged such that the impeller is rotationally driven as receiving hot water supplied to the inside of the housing. According to this embodiment, no power for rotationally driving the impeller is required. Thus, the structure can more effectively be simplified and miniaturized in a lightweight design.

According to another preferred embodiment, the steam generator is arranged such that the ventilation fan is rotationally driven in association with the rotation of the impeller. According to this embodiment, no power for rotationally driving the ventilation fan is required. Thus, the structure can more effectively be simplified and miniaturized in a lightweight design.

According to a further preferred embodiment, the steam generator of the present invention is arranged such that the impeller has air intake fans for drawing the steam in the hot water reservoir, into the inside of the housing through the air intake ports. According to this embodiment, the steam in the hot water reservoir can efficiently be drawn into the inside of the housing by the air intake fans. Thus, the steam can more efficiently be blown off into the room through the steam supply port.

According to still another preferred embodiment, the steam generator of the present invention is arranged such that the housing has an opening of which open degree is adjustable for adjusting the amount of steam to be blown off into the room. According to this embodiment, the amount of steam to be blown off into the room can be adjusted by adjusting the open degree of the opening.

Accordingly, the temperature of the room heated by the steam can optionally be adjusted.

DETAILED DESCRIPTION OF THE PREFERRED EMBODIMENT

The following description will discuss in detail preferred embodiments of the present invention with reference to the attached drawings.

Figure 6:
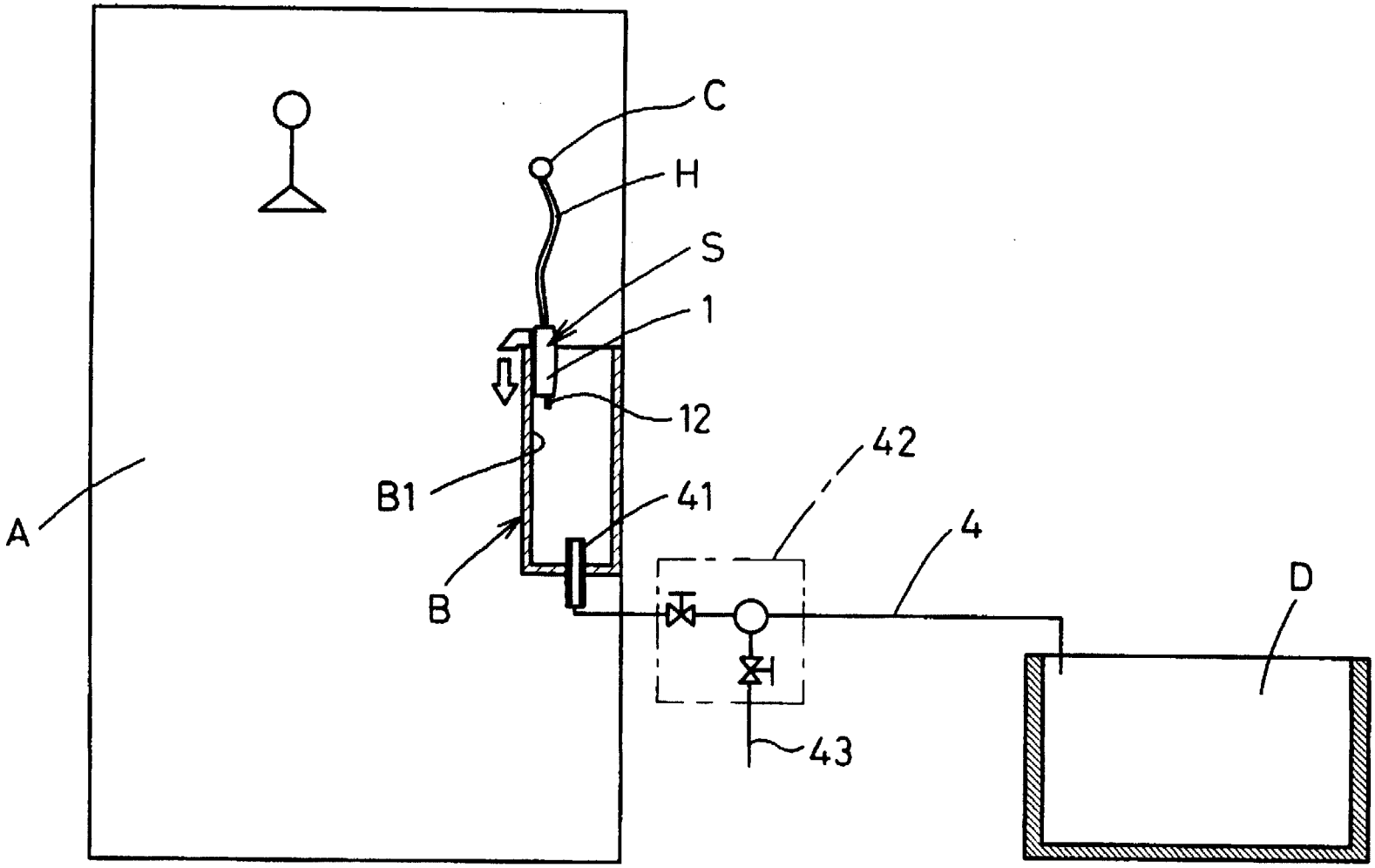
FIG. 6 is a schematic view of a shower room in which the steam generator is installed.

FIG. 6 is a schematic view illustrating a steam generator S of the present invention installed in a shower room A. That is, the steam generator S is installed at an upper portion of a hot water reservoir B disposed inside the shower room A.

Figure 1:
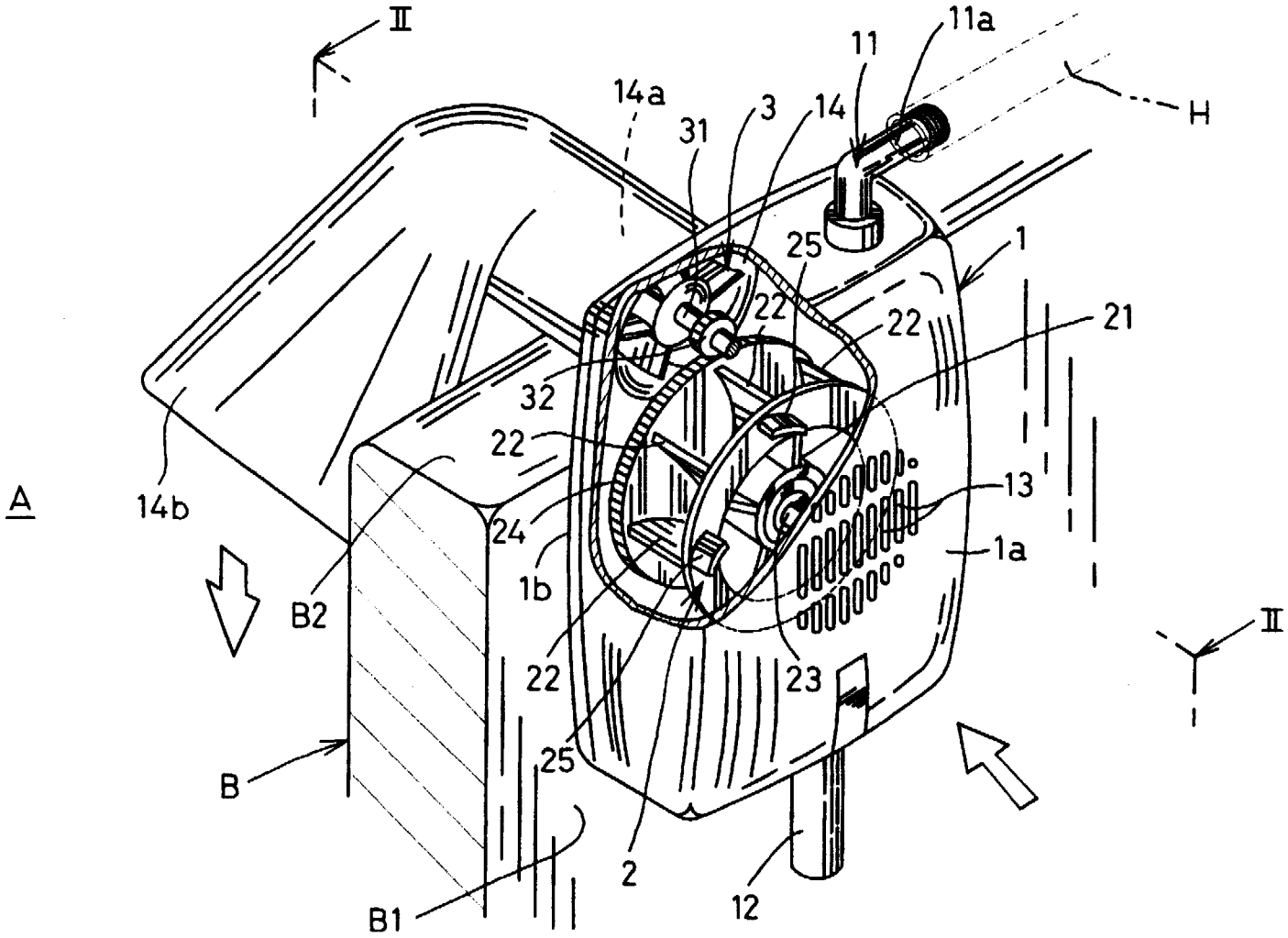
FIG. 1 is a perspective view, with portions broken away, of a steam generator according to a preferred embodiment of the present invention.

As shown in FIG. 1, the steam generator S mainly comprises a hollow container-like housing 1, an impeller 2 for receiving and spreading hot water poured inside the housing 1, and a ventilation fan 3 for blowing off the steam inside the housing 1 into the shower room A.

Figure 2:
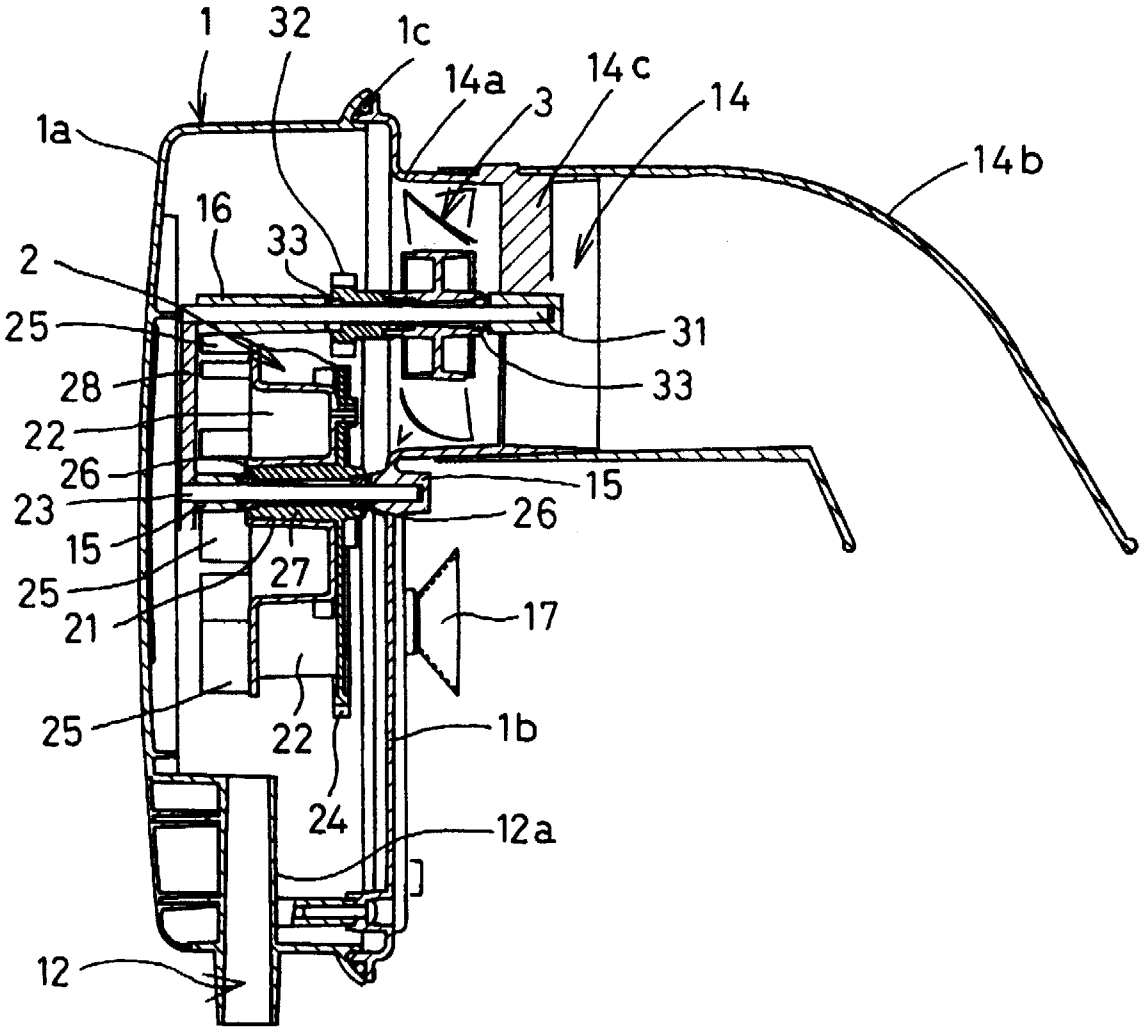
FIG. 2 is a section view taken along the line II—II in FIG. 1.

The housing 1 is generally made of a synthetic resin and made in the form of a hollow container by connecting a tray-like front member 1*a* to a rear member 1*b* through a seal member 1*c* such as an O-ring or the like (See FIG. 2). The housing 1 has a hot water inlet 11 through which hot water is to be poured inside the housing 1, a discharge port 12 through which the hot water poured inside the housing 1 is to be discharged into the hot water reservoir B, air intake ports 13 through which the steam in the hot water reservoir B is drawn into the inside of the housing 1, and a steam supply port 14 for supplying the steam generated in the housing 1 to the shower room A. The housing 1 is disposed inside the hot water reservoir B with the top of the housing 1 projecting from the top of the hot water reservoir B.

Figure 3:
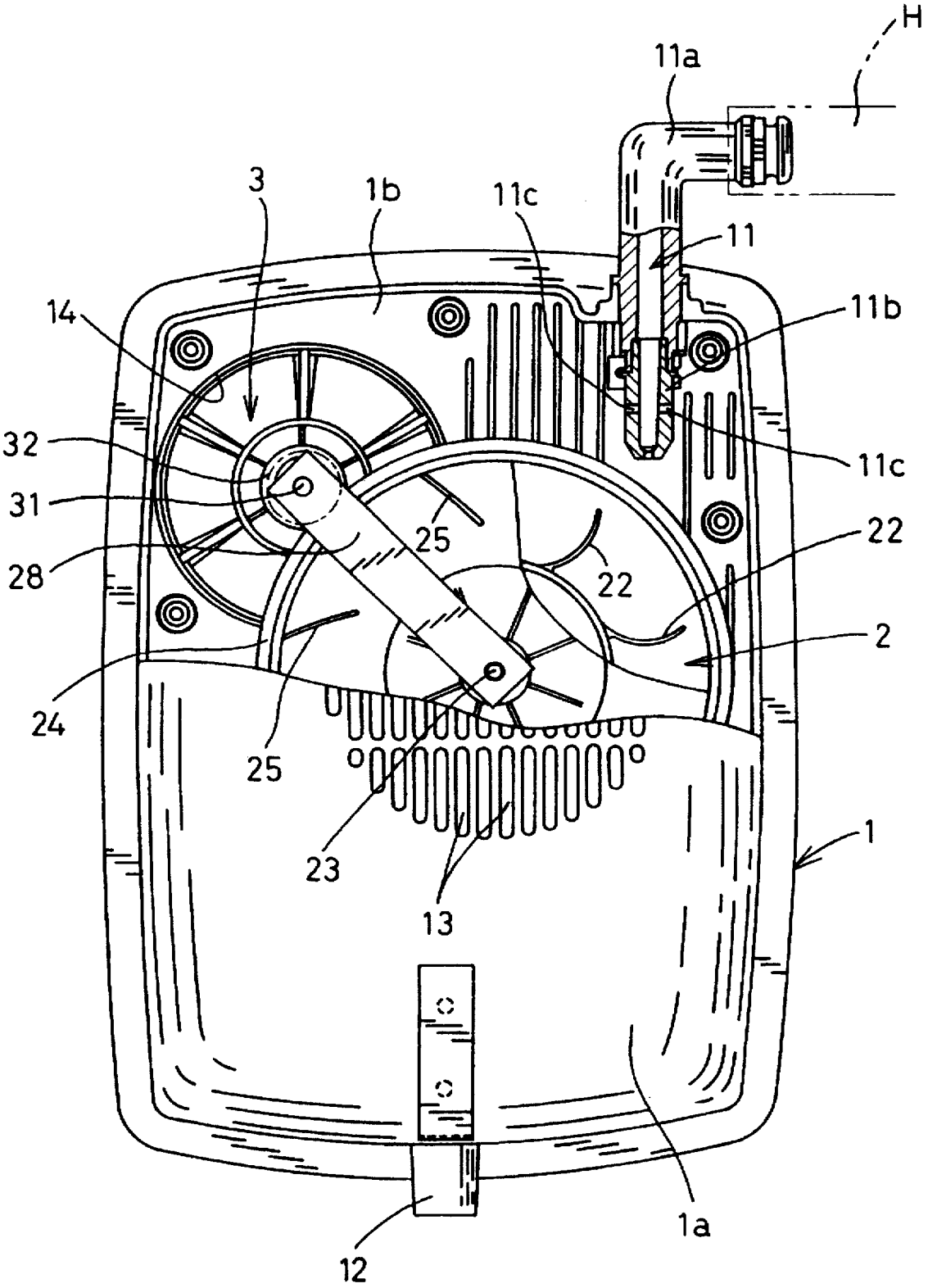
FIG. 3 is a front view, with portions broken away, of the steam generator.

In the hot water inlet 11, an L-shape pipe 11*a* projects from the top of the housing 1 and a nozzle 11*b* is connected to the lower end of the pipe 11*a* (See FIG. 3). The pipe 11*a* communicates with a hot-water cock C through a hose H (See FIG. 6). The nozzle 11*b* is provided in the lateral side thereof with a through-hole 11*c* through which a portion of hot water supplied from the cock C is to be jetted transversely in FIG. 3. The reason why a portion of hot water supplied from the cock C is transversely jetted, is because the amount of hot water poured through the hot water inlet 11 is increased to assure the amount of water required for igniting a hot water supply device of the gas combustion type. Further, hot water jetted through the through-hole 11*c* can effectively increase the temperature of steam inside the housing 1.

In the discharge port 12, an overflow pipe 12*a* passes through the bottom of the housing 1 (see FIG. 2). Accordingly, hot water poured inside the housing 1 through the hot water inlet 11 can be stayed in a predetermined amount on the bottom of the housing 1 before discharged into the hot water reservoir B.

The air intake ports 13 are formed as passing through the front member 1*a* and generally made in the form of a grille. The air intake ports 13 are formed substantially at the center of the front member 1*a*. The steam supply port 14 is formed by a tube member 14*a* horizontally extending from the top of the rear member 1*b*. The underside of the tube member 14*a* is supported by an upper edge B2 of the hot water reservoir B. The steam supply port 14 has a duct 14*b* for guiding the blow-off of steam.

Figure 4:
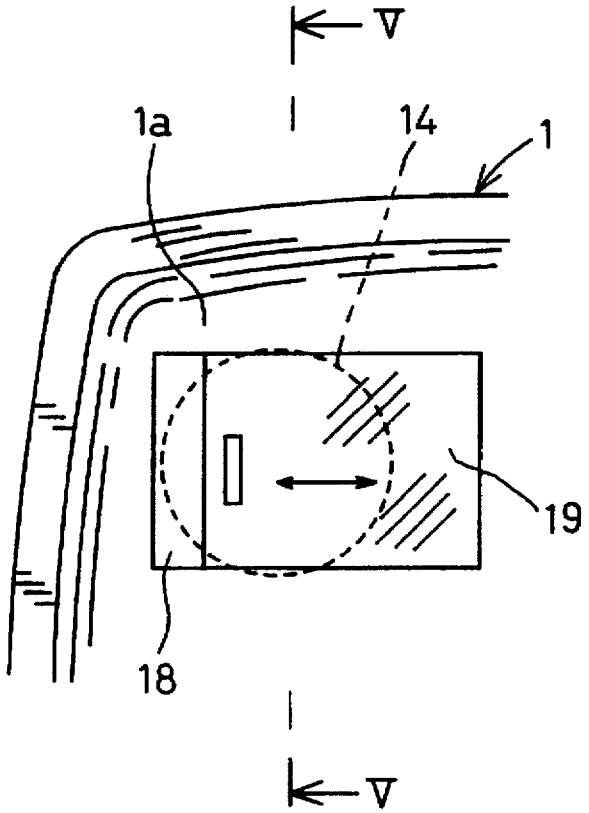
FIG. 4 is a front view of the main portions of the steam generator.
Figure 5:
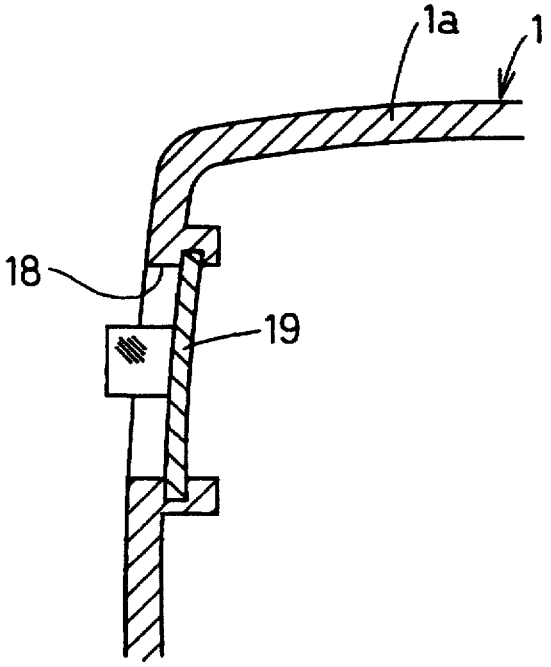
FIG. 5 is a section view taken along the line V—V in FIG. 4.

The front member 1*a* of the housing 1 has an opening 18 at a position opposite to the ventilation fan 3 (See FIGS. 4 and 5). The open degree of the opening 18 can be adjusted by an openable shutter 19. When the open degree of the opening 18 is increased by moving the openable shutter 19, a large amount of outside air is supplied to the ventilation fan 3 through the opening 18. This relatively lowers the amount of steam jetted into the shower room A by the ventilation fan 3. This lowers the temperature of the shower room A heated by steam. When the open degree of the opening 18 is lowered, only a small amount of outside air is supplied to the ventilation fan 3. This relatively increases the amount of steam blown off to the shower room A by the ventilation fan 3. This results in a rise of the temperature of the shower room A heated by steam.

The rear member 1*b* of the housing 1 has a sucker 17 for causing the housing 1 to be adsorbed to an inner wall B1 of the hot water reservoir B (See FIG. 2).

The impeller 2 has a hub 21 around which a plurality of blades 22 are radially disposed, and is provided at the front thereof opposite to the air intake ports 13 with air intake fans 25 for drawing the steam in the hot water reservoir B, into the inside of the housing 1 through the air intake ports 13. The hub 21 is rotatably supported, through a support shaft 23, a ball bearing 26 and a bush 27, by a bearing unit 15 disposed covering over the front member 1*a* and the rear member 1*b* of the housing 1. The blades 22 are disposed such that the tips thereof are arranged to be positioned immediately below the hot water inlet 11. Thus, the blades 22 are to be rotationally driven by hot water poured through the hot water inlet 11. Further, the impeller 2 is provided at the back side thereof with a pear 24 for rotationally driving the ventilation fan 3. The gear 24 is integrally formed with the bush 27.

The ventilation fan 3 is disposed inside the tube member 14*a* forming the steam supply port 14 with the intake side facing the inside of the housing 1. The ventilation fan 3 is supported by a support shaft 31 disposed between a post-like bearing unit 14*c* formed inside the tube member 14*a* and a bearing unit 16 projecting from the front member 1*a* of the housing 1. The ventilation fan 3 is provided at the intake side thereof with a gear 32 of which diameter is sufficiently smaller than that of the gear 24 of the impeller 2. This gear 32 is supported by the support shaft 31 and has one end integrally rotatably fitted to the ventilation fan 3. Further, the gear 32 is meshed with the gear 24 of the impeller 2. Each ball bearing 33 is interposed between the support shaft 31 and the ventilation fan 3, and between the support shaft 31 and the gear 32. Accordingly, the ventilation fan 3 is rotationally driven in association with the rotation of the impeller 2. The amount of air sent by the ventilation fan 3 is set to 1 $mm^3$/min or more. The support shaft 31 of the ventilation fan 3 is connected to the support shaft 23 of the impeller 2 through a connecting plate 28 to prevent the distance between the support shaft 31 and the support shaft 23 from being widened (See FIG. 3).

The hot water reservoir B is connected to a bath tub D through a pipe 4 (See FIG. 6) such that hot water discharged through the discharge port 12 of the housing 1 can be stored in the bath tub D. The pipe 4 is connected to an overflow pipe 41 disposed at the bottom of the hot water reservoir B such that a predetermined amount of hot water always remains in the hot water reservoir B. Disposed in the course of the pipe 4 is a mixing valve 42 to which a water supply pipe 43 is connected. Accordingly, hot water in the hot water reservoir B can be mixed with water using the mixing valve 42 such that the hot water can be supplied to the bath tub D with the temperature thereof lowered to a desired level.

According to the arrangement above-mentioned, when hot water is poured inside the housing 1 through the hot water inlet 11 from the hot water supply cock C, the hot water is received and spread by the impeller 2, which is then rotationally driven. Therefore, steam can continuously be generated inside the housing 1. The steam thus generated is blown off to the shower room A through the steam supply port 14 by the ventilation fan 3 which is interlocked with the impeller 2. The hot water poured inside the housing 1 can be discharged to the inside of the hot water reservoir B through the discharge port 12. The hot water thus discharged generates steam inside the hot water reservoir B, and the steam thus generated is drawn into the inside of the housing 1 through the air intake ports 13 by a sucking operation of the ventilation fan 3 and the air intake fans 25. Together with the steam generated by the impeller 2, the steam thus drawn is blown off into the shower room A through the steam supply port 14. Accordingly, the shower room A can be heated or used as a simple steam bath room.

As discussed in the foregoing, since the steam generator S having the arrangement above-mentioned generates steam by spreading hot water by the impeller 2, the steam can efficiently be generated. Further, steam generated by hot water inside the hot water reservoir B is drawn and blown off to the shower room A. Thus, the steam can more efficiently be supplied to the shower room A. Further, the hot water discharged to the inside of the hot water reservoir B can be reused for bath or the like. This is very economical. Further, the steam generator S is formed by merely disposing the impeller 2, the ventilation fan 3 and the like in the housing 1. Accordingly, the structure is very simple. This can not only make the steam generator in a compact and lightweight design, but also lower the cost.

In particular, the embodiment above-mentioned is arranged such that the impeller 2 is rotationally driven upon reception of hot water supplied to the inside of the housing 1. This eliminates power for rotationally driving the impeller 2. Thus, the structure can more effectively be simplified and miniaturized in a lightweight design. Further, the ventilation fan 3 is rotationally driven in association with the rotation of the impeller 2. This eliminates power for rotationally driving the ventilation fan 3. Thus, the structure can more effectively be simplified and miniaturized in a lightweight design.

In the steam generator S, the impeller 2 has the air intake fans 25 for drawing the steam in the hot water reservoir B, into the inside of the housing 1. Thus, the air intake fans 25 can efficiently draw the steam inside the hot water reservoir B, into the inside of the housing 1. Thus, the steam can more efficiently be blown off into the shower room A.

Figure 7:
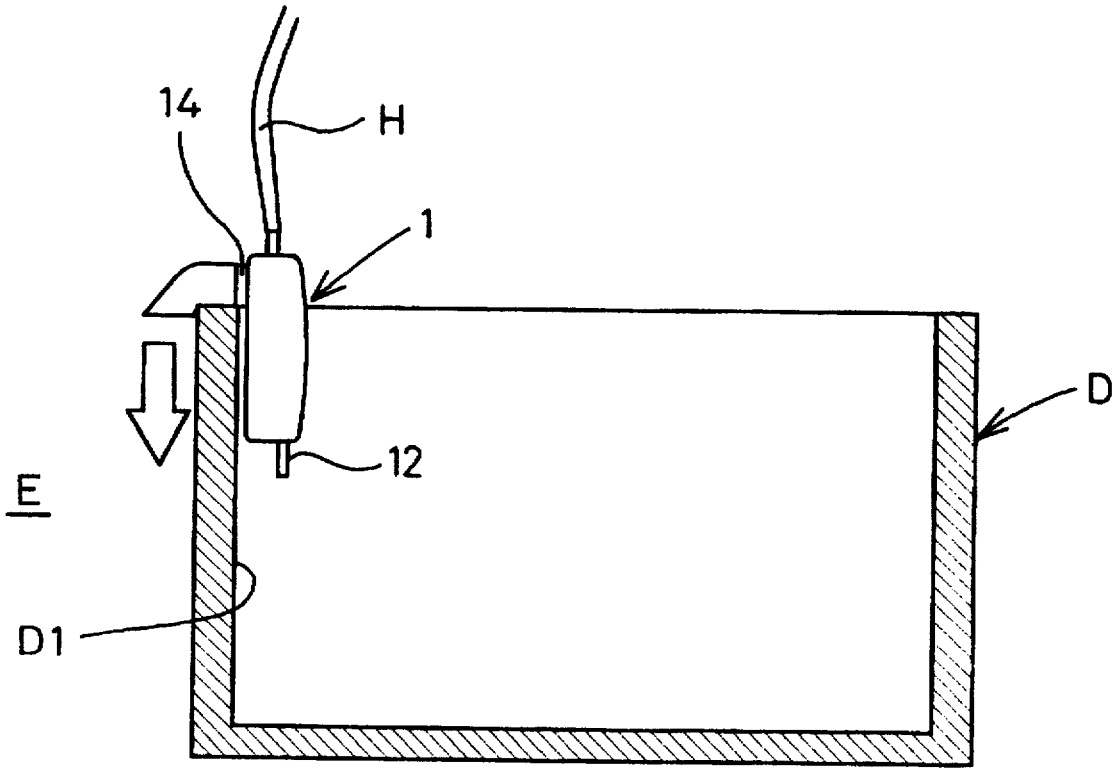
FIG. 7 is a section view of a bath tub in which the steam generator is installed.

The steam generator S may also be used as attached to an inner wall D1 of the bath tub D serving as the hot water reservoir B (See FIG. 7). In such a case, hot water discharged through the discharge port 12 of the housing 1, can directly be stored in the bath tub D. Further, steam generated by the hot water stored in the bath tub D, can be drawn into the inside of the housing 1 through the air intake ports 13. Together with the steam generated by the impeller 2, the steam thus drawn can be blown off into a bath room E through the steam supply port 14. Accordingly, the bath room E can be heated or used as a simple steam bath.

The steam generator S of the present invention should not be limited to the embodiments above-mentioned, but a variety of modifications in designing may be made. For example, the impeller 2 or the ventilation fan 3 may be rotated by a motor to be driven by dry cells. Further, the housing 1 may be installed at a position remote from the hot water reservoir B and, through a pipe or a hose, hot water poured inside the housing 1 may be guided into the hot water reservoir B or the steam inside the hot water reservoir B may be guided inside the housing 1. Further, the steam generator S may be formed in a unitary structure with the hot water reservoir B.

What is claimed is:

1. A steam generator comprising:

a hot water reservoir for reserving hot water, a hollow container-like housing disposed within said hot water reservoir, said housing having a hot water inlet through which hot water is to be poured, a discharge port through which said hot water thus poured is discharged into said hot water reservoir, air intake ports for drawing steam generated in said hot water reservoir, and a steam supply port for supplying steam into a room;

an impeller disposed inside said housing and arranged to receive and spread hot water poured into the inside of said housing through said hot water inlet; and a ventilation fan for blowing off steam generated inside said housing, into said room through said steam supply port.

2. A steam generator according to claim 1, wherein said impeller is rotationally driven as receiving hot water supplied to the inside of said housing.

3. A steam generator according to claim 1, wherein said ventilation fan is rotationally driven in association with the rotation of said impeller.

4. A steam generator according to claim 1, wherein said impeller has air intake fans for drawing steam in said hot water reservoir, into the inside of said housing through said air intake ports.

5. A steam generator according to claim 1, wherein said housing has an opening of which open degree is adjustable for adjusting the amount of steam to be blown off into said room.

* * * * *